United States Patent [19]

Borzoni

[11] Patent Number: 4,475,783

[45] Date of Patent: Oct. 9, 1984

[54] CLIP-IN INTERCONNECTION BUS FOR MULTIPLE FUSE HOLDER ARRAYS

[75] Inventor: John M. Borzoni, Des Plaines, Ill.

[73] Assignee: Littelfuse, Inc., Des Plaines, Ill.

[21] Appl. No.: 295,628

[22] Filed: Aug. 24, 1981

[51] Int. Cl.[3] ..... H01R 9/04

[52] U.S. Cl. ..... 339/19; 339/258 F

[58] Field of Search ..... 339/19, 198 R, 198 G, 339/198 GA, 198 H, 198 K, 222, 252 F, 253 F, 258 F, 259 F, 262 F

[56] References Cited

U.S. PATENT DOCUMENTS

| | | | |
|---|---|---|---|
| 1,536,149 | 5/1925 | Schmid | 339/262 F |
| 1,878,017 | 9/1932 | Steinmayer | 339/262 F |
| 3,668,606 | 6/1972 | Walter | 339/19 |
| 3,831,129 | 8/1974 | Frey | 339/19 |

*Primary Examiner*—Joseph H. McGlynn
*Attorney, Agent, or Firm*—Russell E. Hattis

[57] ABSTRACT

A configurable common terminal bus allows optional engagement of a preselected group of fuse terminals in a fuse holder array. One version of the bus permits substantial rotation of engaged rotatable fuse clip terminals. A breakaway array of fuse holders in conjunction with such a bus facilitates manufacture of fuse blocks with customized terminal groupings. The bus may be replaced after manufacture by one of different configuration to alter the common terminal grouping. The bus may be positioned to occupy a position below that occupied by the inserted fuses so as to be substantially shielded by the insulated portions of the fuse bodies from accidental contact with external objects.

11 Claims, 23 Drawing Figures

FIG. 1A
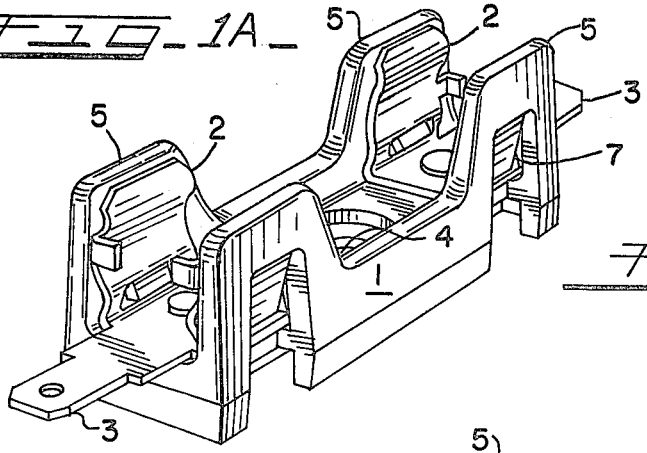
FIG. 2
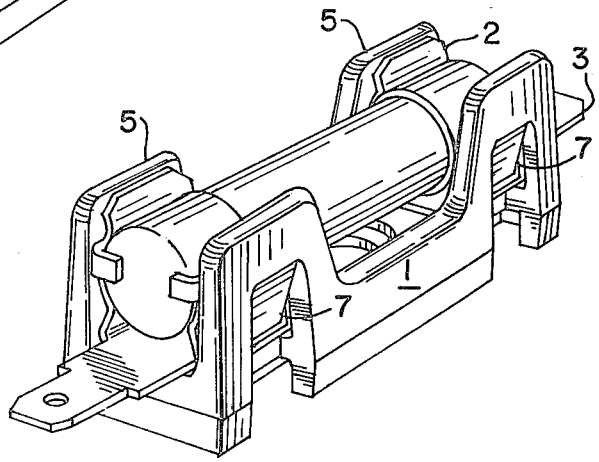
FIG. 1D
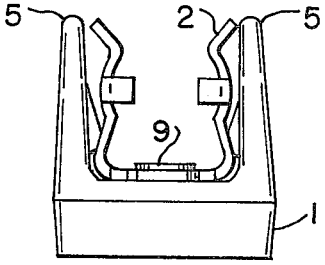
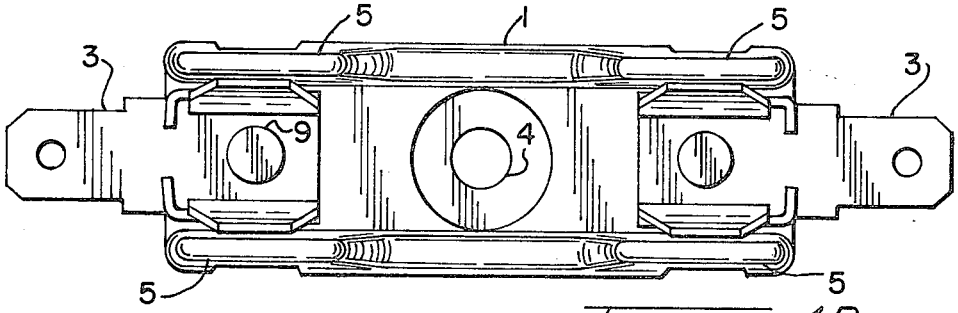
FIG. 1B
FIG. 1C
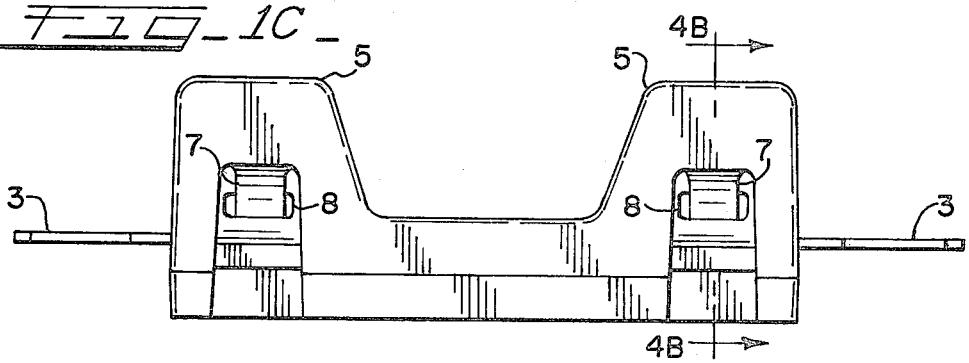

CLIP-IN INTERCONNECTION BUS FOR MULTIPLE FUSE HOLDER ARRAYS

TECHNICAL FIELD

The subject matter of the invention is an improved interconnection bus for arrays of cartridge-type electrical fuses.

BACKGROUND OF PRIOR ART

Conventional clip-in fuse holders for cylindrical cartridge fuses exhibit certain deficiencies with respect to terminal interconnection methods. Such holders typically consist of a pair of spring clips mounted on a base and configured to engage the end terminals of a cylindrical cartridge fuse by pressing insertion. The clips, together with unitary or separate terminal lugs, are normally secured to the base by a metallic rivet passing through a hole in the clip base and through a matching hole passing through the mounting base. Such riveted fuse mounts when fabricated in the form of arrays of parallel individual fuse holders frequently require one or more bus elements to interconnect preselected groups of common fuse terminals, as for example by a common ground strap. These are typically fashioned in the form of a perforated strap to be held in contact with the chosen clips by the rivets. Where the chosen common terminals are adjacent, the bus typically takes the form of a perforated strap with uniform hole spacing. If the common terminals are not adjacent, or if there are short insulating barrier walls between them, the bus must be configured with right-angle tabs. For limited production runs of such arrays the cost of fabricating uniquely configured buses can significantly add to the manufacturing costs. Moreover, riveted buses cannot be modified without substantial disassembly of the array. Accordingly, it is an object of the invention to provide an easily engaged and removed bus that can be readily configured to engage arbitrarily selected clips along a given side of such an array.

Additionally, the cost of fabricating fuse mount arrays of various lengths in limited production runs can be excessive, owing to tooling costs. Accordingly, it is an object of the invention to provide a means whereby arrays of varying number of fuse mounts can be fabricated without incurring such extra costs.

It is a further object of the invention to provide inexpensive busing means for interconnecting an arbitrary group of fuse terminals of an array so fabricated.

The busses of the prior art have their strap or tab portions generally underlying and sandwiched between the clips to be connected and the mounting base. To avoid a vertical displacement between each clip at each fuse holder station of the array and the latter clip, it was necessary to place a spacer beneath each of the latter clips. Accordingly, it is another object of the invention to provide a bus and clip construction which eliminates the necessity for spacers to avoid vertical displacement between the opposed clips at each station.

BRIEF SUMMARY OF INVENTION

A configurable clip-in common-terminal bus is disclosed for use with an array of fuse holders disposed to hold a number of fuses in a parallel row on a unitary base. The bus preferably is fabricated in the form of a long unitary strap carrying a number of conducting shoes unitary with the strap and configured in the form of regularly spaced finger tabs coplanar with the strap and extending perpendicularly away from a common edge. The shoes are configured to slidingly engage a portion of a fuse terminal clip. According to a feature of the invention such a bus configured with shoes on chosen strap points is slidingly engaged into a chosen number of clips on a given side of the row array to provide inexpensive connecting means for a chosen group of common fuse terminals. The shoe configuration is such as to allow engagement with fuse clips mounted by conventional riveting methods, or alternatively with snap-in mounted fuse clips of the type disclosed in an application of Daggett and Nemeth entitled "Fuse Holder Block" (Ser. No. 293,605, filed Aug. 17, 1981) and assigned to the same assignee as the present application.

According to a specific feature of the invention, by appropriate contouring of the engaging surfaces of the shoes a significant measure of rotation of self-aligning clips of the type disclosed in the above-referenced copending application is retained by a clip when engaged by a shoe.

According to a specific feature of the invention, by configuring the clips and shoes to engage close to the mounting base, and by inserting the shoes so as to place the strap between the two clip rows of the array, the insulated bodies of the inserted fuses give a substantial protection against accidental contact with the strap by external objects.

An economical method for manufacturing fuse block arrays of the foregoing type is described. According to a feature of the invention, by fabricating a row array of parallel snap-in fuse holders connected by frangible webs between adjacent bases, and by providing a long configurable common terminal bus of the type described, but wherein the shoes are regularly disposed at intervals equal to the center-to-center distance of adjacent bases, a fuse array of given size with preselected common terminals may be made by breaking off unwanted bases, inserting the fuse clips, cutting or breaking the bus to proper length, cutting off or breaking off unwanted shoes where necessary, and installing the bus to insert the remaining shoes into the clips of the chosen common fuse terminals. Multiple buses drawn to a common array may equally well be employed. By fashioning the mounting base array as a basic configurable block and the basic bus as a long configurable strap, manufacturing costs for limited runs of customized fuse holder arrays are greatly reduced. Discarded blocks may be fashioned into smaller arrays or simply broken up to make individual units. Since the bus is removable, a given block array may be reconnected at will by inserting a suitably configured replacement bus.

To make the use of spacers unnecessary, the clip jaws are designed to support each fuse at an elevation which spaces the fuse from the clip base. The bus is positioned to extend beneath the fuses with the shoes thereof engaging with the clip jaws adjacent to the clip bases.

Other objects, advantages, and features of the invention will become apparent from the description to follow, the drawings, and the claims.

BRIEF DESCRIPTION OF DRAWINGS

FIGS. 1A, 1B, 1C, and 1D are a perspective view, a top plan view, a front elevational view, and a side elevational view, respectively, of a clip-in fuse holder;

FIG. 2 is a perspective view of the holder with a fuse inserted;

DETAILED DESCRIPTION OF INVENTION

Figure 3:
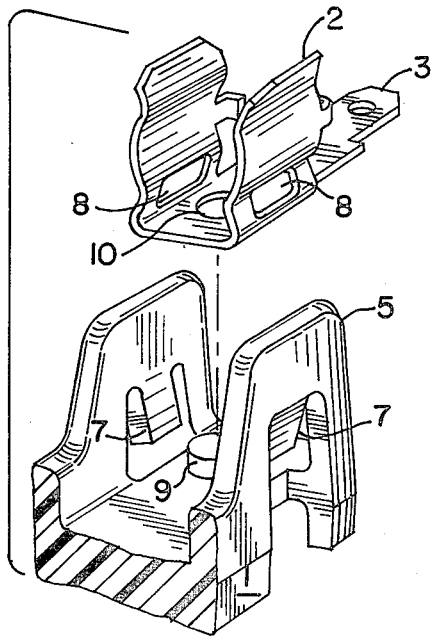
FIG. 3 is an exploded perspective view showing one end of the fuse holder with a clip positioned for insertion from above.
Figure 4A:
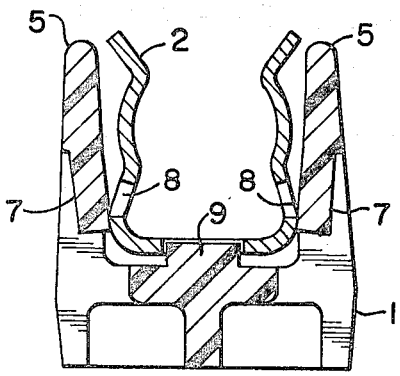
FIGS. 4A and 4B are cross-sectioned side elevations showing details of the fuse insertion and fuse locking mechanism.
Figure 4B:
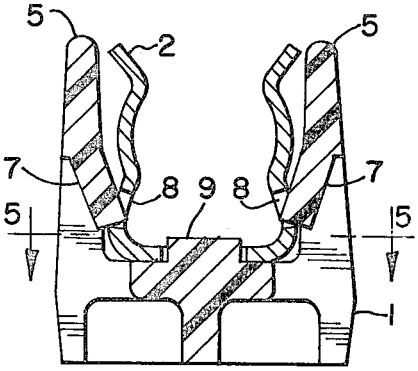

FIGS. 1 through 5 show various views and aspects of a fuse-mounting block featuring a snap-in engagement for fuse-mounting clips as described in the previously referenced co-pending application of Daggett and Nemeth. The subject matter of the present invention is a removable configurable interconnection bus for interconnecting a chosen group of fuse clips into a common electrical node when fabricated into an array. The present disclosure is directed in particular to a configurable bus which is capable of engaging fuse clips of the type described by Daggett and Nemeth, or alternatively to conventional fuse clips which are mounted by standard riveting techniques to an insulating base.

The exemplary form of their invention is shown in FIGS. 1A, 1B, 1C and 1D, and consists of a unitary insulating mounting base 1 and two conducting fuse holding clips 2, the base and the clips being configured to lockingly engage together under snap-in pressing engagement. A central hole 4 in the base 1 allows passage of a mounting screw (not shown). Two connecting lugs 3 unitary with each clip 2 extend away from the mounting base 1. The clips 2 are partially shrouded by insulating barrier walls 5, which provide a measure of protection against accidental electrical contact of external objects with the clip structure. FIG. 2 shows a fuse holder with a cartridge fuse 6 installed.

The barrier walls 5 further serve as part of the clip anchoring assembly. FIG. 3 shows details of a clip 2 positioned for insertion. The clip 2 is mounted on the base by pressing the clip downward between two compliant wall-mounted locking tabs 7 (FIGS. 4A and 4B), forcing them outward until the clip is fully seated on the base. Locking slots 8 (FIGS. 3, 4A, 4B) in the clip are then engaged by inward motion of the locking tabs, securing the clips to the base. A unitary post 9 extending up form the base 1 engages a hole 10 in the base of the clip 2 to secure the clip against lateral motion.

Figure 5:
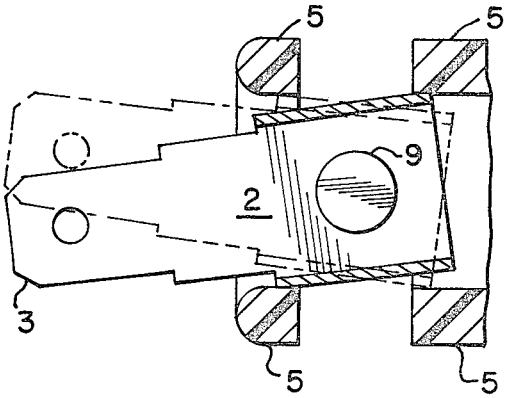
FIG. 5 is a top plan view in cross section showing rotation limiting engagement of the base of a fuse clip with the walls.

Referring to FIG. 1C, it will be noted that the engaging slots 8 are configured longer than the width of the locking tabs 7, thereby permitting the clips to rotate about the mounting posts 9 as shown in FIG. 5. The amount of rotation is restrained by close proximity of the interior surface of each of the walls 5 (FIG. 5) to the base of the clip 11, thereby holding the clip in proper alignment for fuse insertion and insuring that no substantial motion of the lug 3 can occur to cause an accidental short circuit to adjacent structures. For additional pull strength during fuse removal the posts may be crowned after assembly by conventional hot-forming methods well known to the art.

Figure 9:
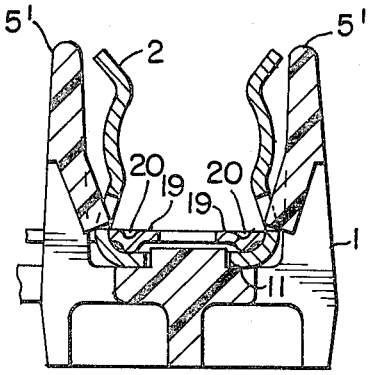
FIG. 9 is a cross-sectional end elevation of one fuse clip engaged by a shoe.
Figure 6:
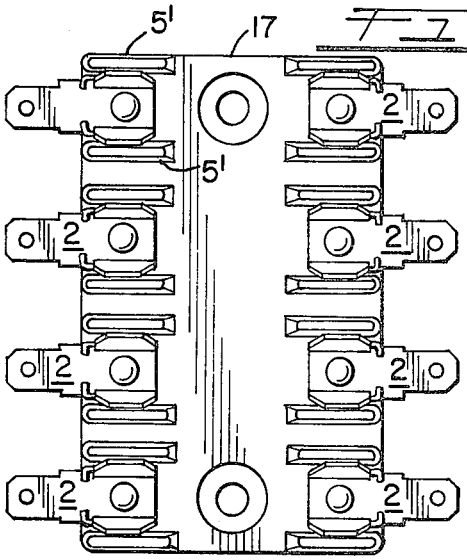
FIG. 6 is a top plan view of an array of four parallel fuse holders of the preferred form.
Figure 10:
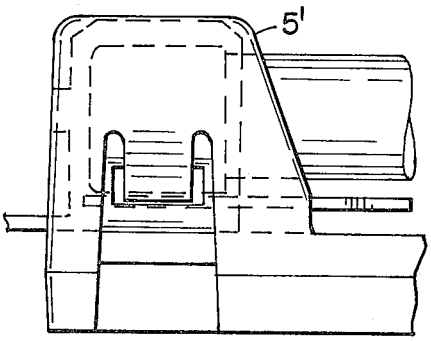
FIG. 10 is side elevation of one end of a fuse mount with the bus engaged, showing the location of the bus between the face of the fuse mount and the body of an inserted fuse.
Figure 8:
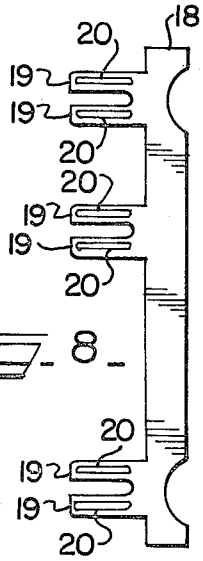
FIG. 8 shows the configured bus of FIG. 7.

The fuse holders as previously described may easily be fabricated in a row array, as shown in FIG. 6 wherein an array of four fuse holders of the type shown in FIGS. 1A–1D are formed on a common base 17. To allow common connection of a preselected group of terminals, a conducting finger bus 18 (FIG. 8) is fabricated with pairs of finger shoes 19 disposed along its length. By placing the bus 18 along the center of the fuse mount 17 and pressing the finger shoes 19 into engagement with the clip bases 2, the selected terminals are electrically connected. Inward compliance of the individual fingers serves to hold the fingers 19 into tight engagement with the fuse clips 2 (FIG. 9). Each finger 19 is provided with a lengthwise dimple 20 to press against the clip base 11, thereby providing in conjunction with the outward pressing contact with the clip jaws 21 a four-pole contact with the clip 2 to assure a mechanically strong engagement characterized by low electrical resistance. In FIG. 9 the contours of the clip jaws 2 are configured in the vicinity of the base so as extert a pressure on the shoe to force it into pressure contact with the base on either side. FIG. 10 is a side view of an engaged bus.

Figure 7:
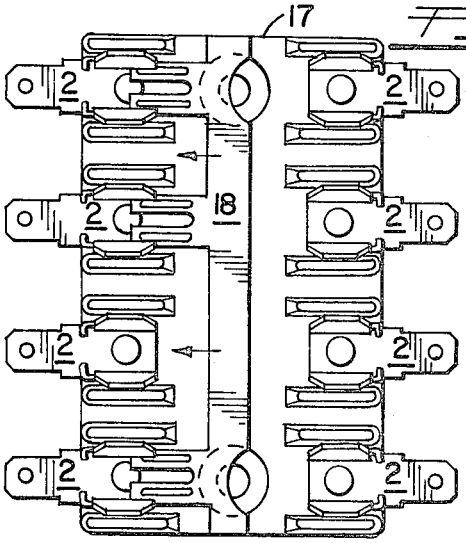
FIG. 7 is a top plan view of the fuse holder of FIG. 6 wherein a three-terminal common bus is shown in partial engagement with selected clips.
Figure 13:
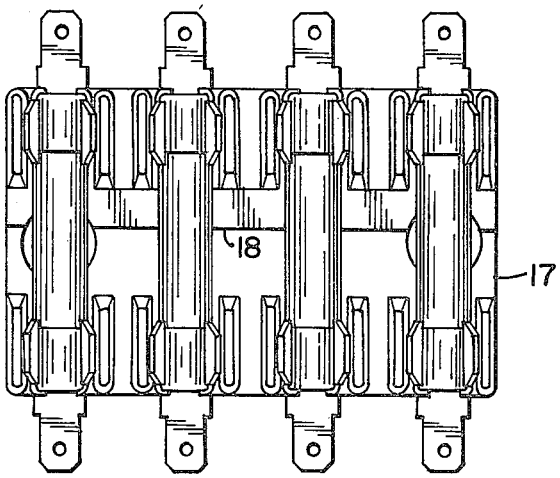
FIG. 13 is a top plan view of the interconnected array of FIG. 7 with the interconnection bus completely inserted, and four fuses inserted thereafter, showing the shielding action of the fuse bodies to prevent accidental contact with the bus.

FIG. 13 shows a top plan view of the array of FIG. 7 with fuses inserted, and shows that the insulating fuse bodies 22 assist in protecting the bus from accidental contact with external objects. Additionally, the bus may be withdrawn and replaced by one of different configurations to change the interconnection pattern at will. This accomplishes one of the objects of the invention. The clip engagement shown in FIG. 7 may also be used with conventional riveted structures.

Figure 14A:
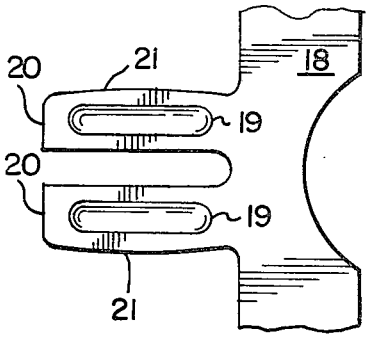
FIG. 14A is a plan view of a single bus shoe, showing a moderate arc contour of the jaw engaging faces.
Figure 14B:
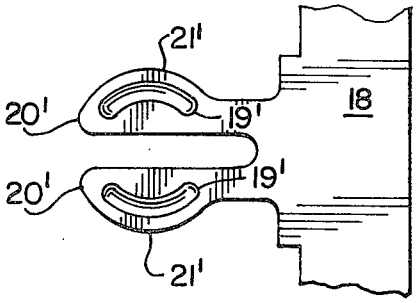
FIG. 14B is a plan view of an alternative bus shoe wherein the contour radius of the jaw engaging faces of the shoe are centered on the pivot point on the clip base to facilitate clip rotation.
Figure 14C:
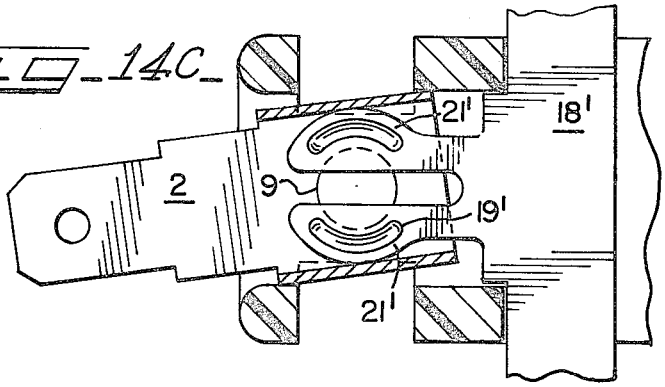
FIG. 14C is a plan view of a shoe of the type shown in FIG. 14B engaged in a clip of the type shown in FIG. 5, showing the rotational capability of the strongly contoured shoe.

FIG. 14A is an enlarged plan view of one form of engaging shoe. The two outer engaging surfaces 21 of the fingers 20 are configured convex outwardly from the center of the shoe so as to provide a well localized pressure contact region for engaging with the base of the clip jaw after insertion. FIG. 14B shows an alternative version of busing shoe wherein the outer contours 21' are circular arc sectors centered on the central region of the shoe. FIG. 14C shows a shoe as shown in FIG. 14B engaged with the fuse clip 2 of the type shown in FIG. 5. By centering the contours 21' of FIG. 14B of the central region of the shoe, the shoe when engaged as in FIG. 14C permits a significant degree of rotation of the clip 2 about the post 9, while still maintaining a desired four-terminal contact. Thus, a significant degree of rotation of the clip is allowed even when engaging the bus 18' thereby preserving the self-aligning feature of the rotating clip disclosed by Daggett and Nemeth.

Figure 11A:
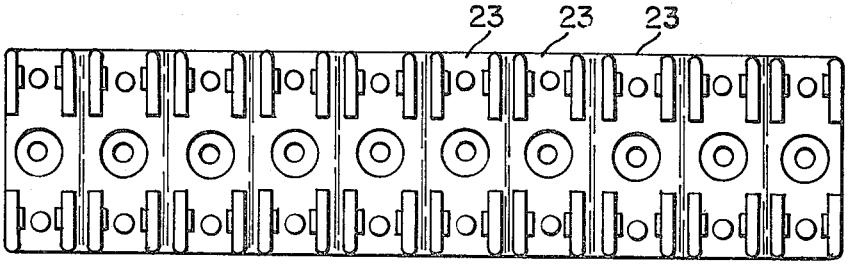
FIGS. 11A and 11B are a top plan view and a front elevation, respectively, of a breakaway array of ten fuse mount bases.
Figure 11B:
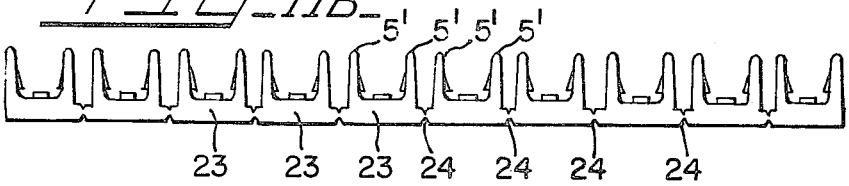
Figure 11C:
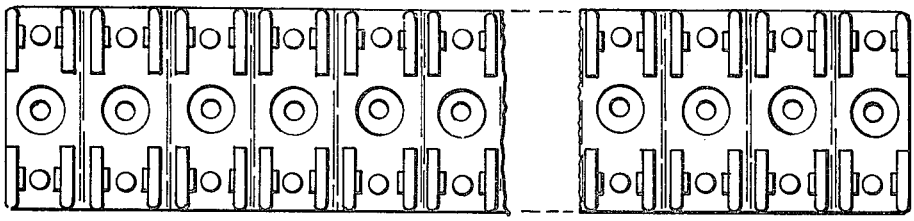
FIG. 11C is a top plan view of the breakaway array of FIG. 13A wherein a block of four has been broken away for subsequent fabrication.
Figure 12A:
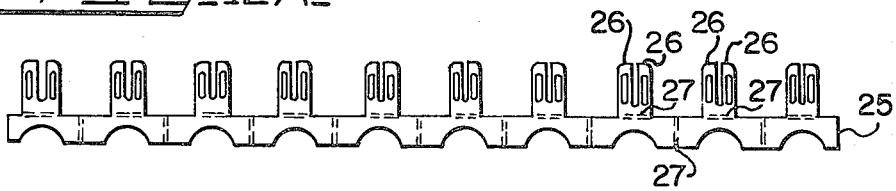
FIG. 12A is a top plan view of a configurable interconnection bus of ten shoes.
Figure 12B:
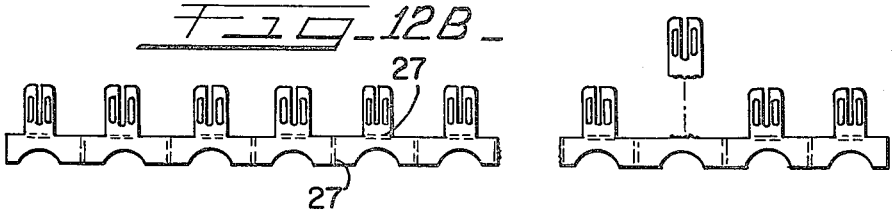
FIG. 12B shows the configurable bus of 12A wherein a portion has been severed and configured to form the equivalent of the configurable bus of FIG. 8.

The bus and mounting block may be configured for mass production of fuse arrays of variable number and custom interconnection. FIGS. 11A and 11B show a row of fuse holder bases 23 interconnected by breakaway webs 24. A standard large block may thus be broken into blocks of smaller size as shown in FIG. 11C at will, and fuse mounting clips of the type described herein may be mounted thereon. A standard configurable bus 25 (FIG. 12A) has pairs of finger shoes 26 or similar engaging means disposed at regular intervals along its length. To reproduce a given interconnection, as for example that of FIG. 7, the bus is either cut by conventional methods or alternatively broken along breakaway webs 27 to produce the desired configuration, as shown in FIG. 12B. After clip insertion, the configured bus is then inserted as previously described.

The prefabricated configurable fuse array method thus allows for custom small-lot fuse holder array production with custom terminal interconnection without requiring special tooling, and hence at significantly reduced cost. This accomplishes one of the objects of the invention.

While for the purpose of illustration, various forms of this invention have been disclosed, other forms thereof may become apparent to those skilled in the art upon reference to this disclosure and, therefore, this invention shall be limited only by the scope of the appended claims.

I claim:

1. A bus for an open frame fuse holder array for a plurality of insertable electrical cartridge fuses having cylindrical coaxial end terminals at opposite ends thereof, said array having a plurality of longitudinally spaced and aligned pairs of electrically conducting spring clips between which said fuses are to extend at right angles to the longitudinal axis of the array, each of said clips including a clip base pivotally mounted on said mounting base and a pair of fuse terminal-receiving clip jaws, said bus comprising a unitary strap-like main conductor and a plurality of parallel unitary electrically-conducting connecting shoes disposed in spaced-apart relationship and extending in the same direction away from the same side of said main conductor, said shoes having outwardly facing and convex arcuate portions configured frictionally to engage the interior portions of said clips and to allow rotation of the engaged clips while maintaining electrical and mechanical contact therewith.

2. The bus of claim 1 wherein said shoes are configured to engage said clips with said main conductor disposed between said major surface of said mounting base and fuses inserted in said fuse holder array to permit engagement by said connecting shoes with said chosen clips on the bases of said clips or between the bases of said clips and said inserted fuses.

3. The bus of claim 1 wherein each said shoe is configured in the form of two inwardly compliant substantially parallel fingers, an outer portion of each of said fingers configured with said outwardly convex arcuate portion to slidingly frictionally rotatingly engage said interior portions of a clip.

4. The bus of claim 3, wherein said arcuate portions of the fingers of each said shoe are substantially circular arcs centered on the central region of each said shoe.

5. An assembled parallel fuse holder array for a plurality of insertable electrical cartridge fuses having cylindrical coaxial terminals at opposite ends thereof, said assembled array comprising:

an insulating mounting base; a plurality of pairs of longitudinally spaced and aligned electrically conducting clips on said base and between which said fuses are to extend at right angles to the longitudinal axis of said fuse holder array, each of said clips comprising a clip base secured to said mounting base and a pair of spaced, confronting clip jaws unitary with and extending upwardly from said clip base with major jaw surfaces thereof facing one another, portions of each of said clip jaw surfaces configured with contours to springingly lockingly engage a cylindrical fuse terminal pressed between said jaws and support the same above said clip base, the engagement axis defined by said contours disposed substantially parallel to said clip base; and a unitary electrically-conducting connecting bus located between said pair of clips and engaged with a plurality of chosen corresponding clips of said pairs of clips, said bus comprising a longitudinally extending strap-like main conductor and a plurality of parallel unitary electrically conducting shoes disposed in longitudinally spaced-apart relationship and extending laterally in the same direction away from said main conductor, said shoes engaging by sliding frictional engagement portions of the clips beneath the interior portions of the jaws which engage the fuse terminals, so that said shoes are retained in an engaged condition solely by said frictional engagement and so that the bus is positioned to be located between the fuses to be supported by the clips and the mounting base.

6. The fuse holder array of claim 5 wherein each said shoe is configured in the form of two inwardly compliant substantially parallel fingers, each of said fingers configured to slidingly frictionally engage an interior portion of a clip.

7. The fuse holder array of claim 5 wherein said shoes are configured to permit rotation of the clips relative thereto during fuse insertion, while maintaining electrical and mechanical contact therewith.

8. The fuse holder array of claim 5 wherein each bus shoe is configured in the form of two inwardly compliant substantially parallel fingers, each of said fingers configured to slidingly frictionally engage an interior portion of a clip jaw.

9. The fuse holder array of claim 5 wherein the number of shoes extending from said strap and engaging chosen clips along said row axis is less than the total number of clips disposed along said row axis so as to constitute selective busing which skips some of the fuse holder stations of the array.

10. The fuse holder of claim 5 wherein a portion of the outer edge of each said shoe finger being configured in an outwardly convex arcuate form to permit rotation of the engaged clip relative thereto.

11. The fuse holder array of claim 10 wherein the arcuate portions of the fingers of each said shoe are substantially circular arcs centered on the central region of each said shoe.

* * * * *